US006889646B2

(12) United States Patent
Kurokawa et al.

(10) Patent No.: US 6,889,646 B2
(45) Date of Patent: May 10, 2005

(54) CAM MECHANISM WITH DECOMPRESSION DEVICE

(75) Inventors: Masaya Kurokawa, Wako (JP); Akihiro Iida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/790,942

(22) Filed: Mar. 1, 2004

(65) Prior Publication Data

US 2004/0187825 A1 Sep. 30, 2004

(30) Foreign Application Priority Data

Mar. 17, 2003 (JP) ..... 2003-071175

(51) Int. Cl.[7] ..... F01L 13/08
(52) U.S. Cl. ..... 123/182.1
(58) Field of Search ..... 123/182.1

(56) References Cited

U.S. PATENT DOCUMENTS 3,901,199 A * 8/1975 Smith ..... 123/182.1
3,981,289 A * 9/1976 Harkness ..... 123/182.1
4,696,266 A * 9/1987 Harada ..... 123/182.1
4,991,551 A * 2/1991 Terai et al. ..... 123/182.1
5,085,184 A * 2/1992 Yamada et al. ..... 123/182.1
5,184,586 A * 2/1993 Buchholz ..... 123/182.1
5,197,422 A * 3/1993 Oleksy et al. ..... 123/182.1
5,823,153 A * 10/1998 Santi et al. ..... 123/182.1
5,992,367 A * 11/1999 Santi et al. ..... 123/182.1
6,439,187 B1 * 8/2002 Dietz et al. ..... 123/182.1
6,543,403 B2 * 4/2003 Kawamoto ..... 123/182.1
6,672,269 B1 * 1/2004 Bonde et al. ..... 123/182.1

FOREIGN PATENT DOCUMENTS

JP 64-46409 3/1989

* cited by examiner

*Primary Examiner*—Henry C. Yuen
*Assistant Examiner*—Arnold Castro
(74) *Attorney, Agent, or Firm*—Merchant & Gould P.C.

(57) ABSTRACT

This invention relates to a cam mechanism with a decompression device formed by integrating a centrifugal weight and a decompression cam lobe. The decompression device is formed by preparing a cylindrical shaft having a decompression cam lobe at one end of the shaft and a centrifugal weight at the other end. The device is constructed to be disposed on a camshaft by inserting the decompression cam lobe into a grove portion of a second cam, and pivotally supporting the shaft receiving hole on the camshaft.

2 Claims, 8 Drawing Sheets

CAM MECHANISM WITH DECOMPRESSION DEVICE

CROSS REFERENCE TO RELATED APPLICATIONS

This application is based on Japanese Patent Application No. 2003-071175 filed on Mar. 17, 2003.

FIELD OF THE INVENTION

The present invention relates to a cam mechanism with a decompression device which reduces the compression pressure in a combustion chamber of a reciprocating internal combustion engine to facilitate starting.

BACKGROUND OF THE INVENTION

In a reciprocating internal combustion engine, an air/fuel mixture, introduced into a combustion chamber by opening an intake valve, is compressed by a piston in a cylinder and burnt. The piston reciprocates due to the energy of this burning thereby resulting in motive power. Pressure in the cylinder can make engine starting difficult. However, pressure in the cylinder during operation is desirable to maximize performance and engine efficiency. Therefore, when the revolution of the engine is lower than a given speed, such as during starting, a decompression device can be provided to open the exhaust valve to displace the compressed air/fuel mixture. In particular, auxiliary cam lobes that open the exhaust valve to reduce the pressure of the air/fuel mixture in the combustion chamber before the air/fuel mixture is compressed and burnt can be provided. (For an example, refer to Japanese Patent Publication No. S64-46409.) Decompression devices can include a centrifugal weight which rocks due to the centrifugal force caused by the rotation of a camshaft, and a decompression pin which protrudes from and can be inserted into the cam with the centrifugal weight.

The problem with the prior art systems is that the centrifugal weights and the decompression pins are configured as separated pieces of the decompression device. Accordingly, the overall number of parts of the camshaft system is increased and it is therefore more difficult to combine the parts. Moreover, in the prior art systems, it is necessary to enlarge the cam lobe in order to attach the decompression device thereto.

In view of such a problem, an object of the present invention is to provide a cam mechanism with a decompression device wherein the centrifugal weight and the decompression cam lobe are integrally configured, improving the combining characteristic of the decompression device and achieving a small sized decompression device.

BRIEF SUMMARY OF THE INVENTION

In order to solve the above-described problems, a cam mechanism with a decompression device according to the present invention includes: a camshaft driven to rotate in conjunction with a crankshaft including at least one and a guide part formed in vicinity of the cam; a flange member disposed on the camshaft, facing the cam with the guide part interposed therebetween; and a decompression cam including a cylindrical shaft part, a decompression cam lobe formed on a circumferential surface side at one end of the shaft part, and a centrifugal weight part extending in a direction orthogonal to an axis of this shaft part at the other end of the shaft part.

A groove portion in the cam is provided opposite the cam lobe with the camshaft interposed therebetween. A shaft receiving hole, penetrating through the guide part in parallel with the camshaft, is formed at a position facing the groove portion, in the guide part.

The decompression cam is disposed in such a manner that the shaft part of the decompression cam is inserted into the shaft receiving hole and pivotally supported. The decompression cam lobe is inserted into the groove portion and the centrifugal weight part is positioned between the guide part and the flange member.

Therefore, the cam mechanism with a decompression device is configured so that when the camshaft rotates at a given rotational speed or less, the centrifugal weight part is positioned in vicinity of the camshaft, whereby the decompression cam lobe is protruded outward from the groove portion. When the camshaft rotates faster than the given rotational speed, the centrifugal weight part is separated from the camshaft by centrifugal force causing the shaft part to rotate. Accordingly, the decompression cam lobe is positioned inside the groove portion.

According to this configuration, since the centrifugal weight and the decompression cam lobe are integrally configured as a decompression cam, the number of parts is reduced. The reduced number of parts results in a small sized decompression device having improved combining characteristic.

Note that the cam mechanism with the decompression device according to the present invention preferably further includes: a spring attached portion formed in such a manner that the decompression cam is extended along the axis of the shaft part; and a return spring wound around the spring attached portion and having elasticity, wherein a latching portion for latching the return spring is formed in the centrifugal weight part, in the vicinity of the shaft part, and one end of the return spring is latched with the latching portion, the other end is latched onto the camshaft, and the centrifugal weight part is energized toward the camshaft by energizing force of the return spring.

According to this configuration, the combining characteristic of the return spring is improved. At the same time, since the return spring is supported on the axis of the shaft part, which is the center of the rocking movement of the decompression cam, it becomes possible to favorably maintain an operational characteristic by energizing the centrifugal weight toward a camshaft side against the centrifugal force imposed on the centrifugal weight, thus improving the starting characteristic of an internal combustion engine.

DETAILED DESCRIPTION OF THE INVENTION

Figure 2:
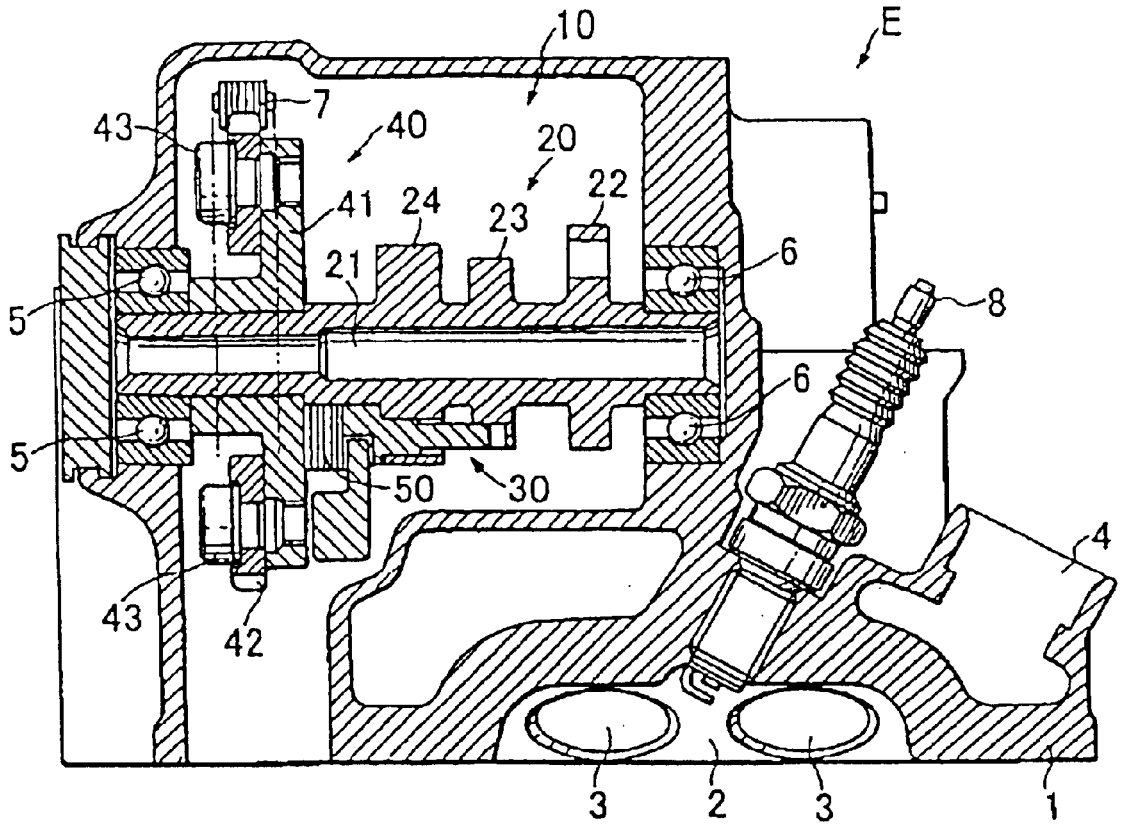
FIG. 2 is a sectional view showing an internal combustion engine in which the cam mechanism with the decompression device according to the present invention is installed.

Hereinafter, preferred embodiments of the present invention will be described with reference to the drawings. First, referring to FIG. 2, a description will be given of an internal combustion engine in which a cam mechanism with a decompression device according to the present invention is installed. FIG. 2 shows a cylinder head 1 of an internal combustion engine E. A combustion chamber 2 formed in the cylinder head 1 communicates with intake ports (not shown) and exhaust ports (not shown) via intake inlets 3 and exhaust outlets (not shown), respectively. Mushroom-shaped intake valves and exhaust valves (neither shown) are attached to these intake inlets 3 and exhaust outlets and are energized by springs to normally close the intake inlets 3 and the exhaust outlets.

On an upper portion of the cylinder head 1, a cam mechanism 10 with a decompression device according to the present invention is disposed. The cam mechanism 10 is rotatably installed with its ends supported by the cylinder head 1 with bearings 5 and 6, and includes a camshaft 20 having thereon an intake cam 22, an exhaust cam 23, a decompression cam 30, and a sprocket 40, which are attached to this camshaft 20. The rotation of a crankshaft (not shown) of the internal combustion engine E is transmitted to the camshaft 20 by the sprocket 40 and a timing chain 7 looped around this sprocket 40, thus causing the intake cam 22 and the exhaust cam 23, formed on the camshaft 20, to rotate. Cam lobes are formed in the intake cam 22 and the exhaust cam 23, and these cam lobes push down the intake valves and the exhaust valves directly, or by use of swing arms or rocker arms. Accordingly, the intake inlets 3 and the exhaust outlets are opened at respective timings determined by angles with which the respective cam lobes are formed relative to the axis of the camshaft 20. After an air/fuel mixture introduced in the combustion chamber 2 from the intake inlets 3 is compressed by an unillustrated piston, the air/fuel mixture is ignited by an ignition plug 8 and burnt to become energy which displaces the piston thereby rotating the crankshaft. Thereafter, the exhaust gas is forced out of the exhaust outlets through the exhaust ports.

Figure 1:
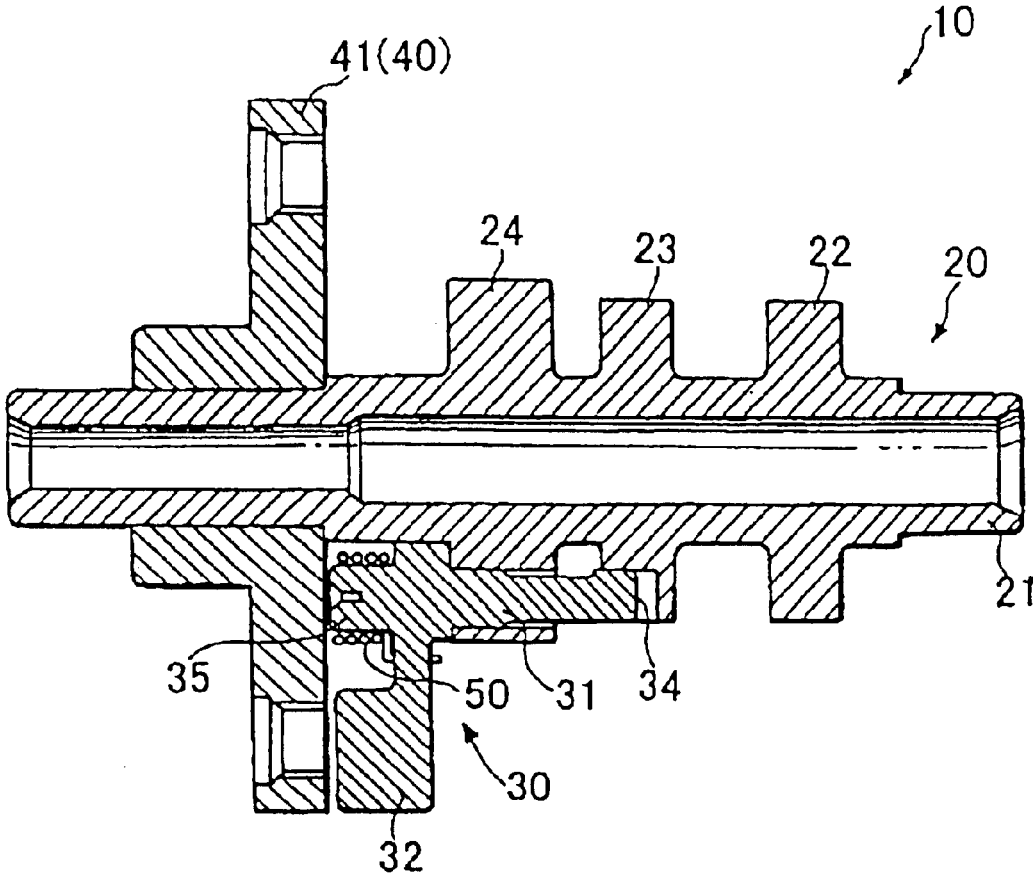
FIG. 1 is a sectional view (taken along the I—I line of FIG. 3) showing a cam mechanism with a decompression device according to the present invention.
Figure 3:
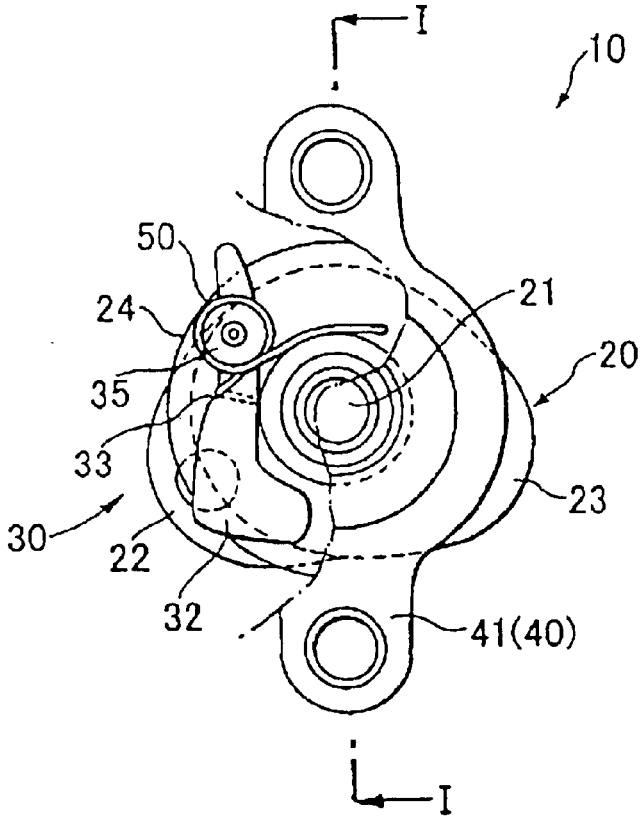
FIG. 3 is a front view of the cam mechanism with the decompression device according to the present invention, viewed from an axis direction of a camshaft.
Figure 4:
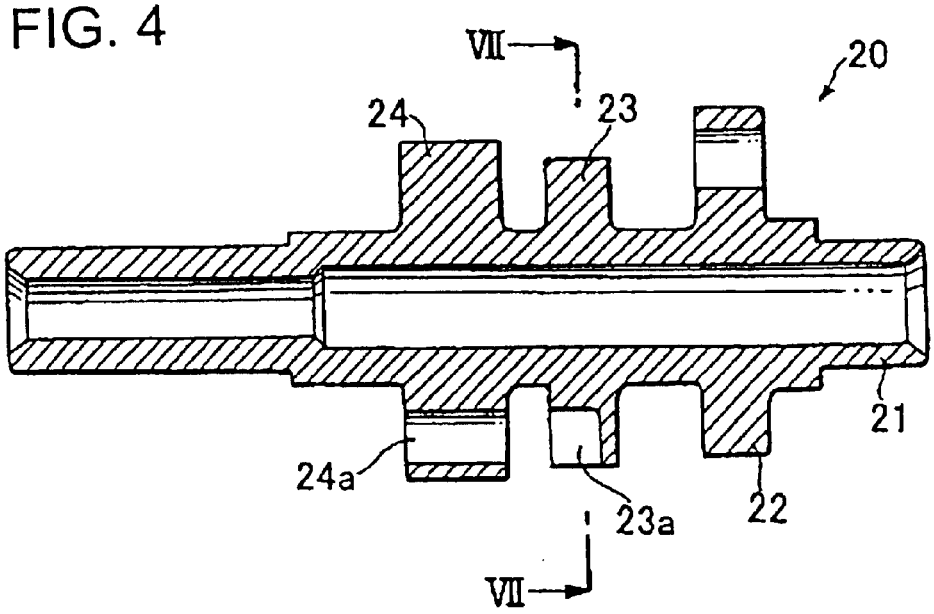
FIG. 4 is a sectional view including an axis of the camshaft.
Figure 5:
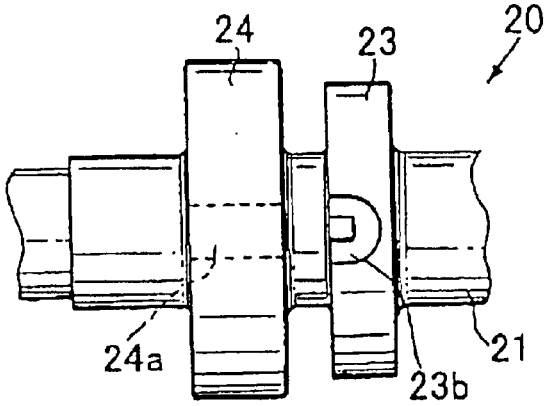
FIG. 5 is a side view of essential part of the camshaft.
Figure 6:
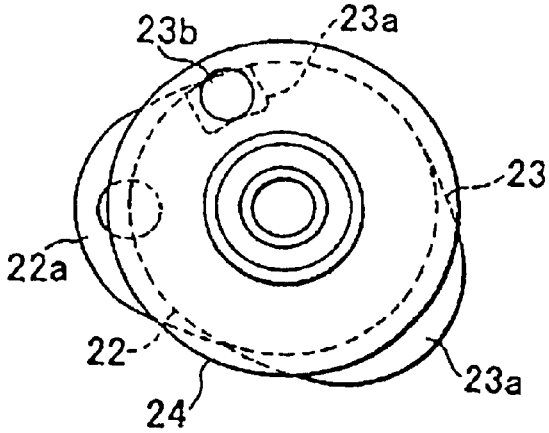
FIG. 6 is a front view of the camshaft, viewed in a direction from a guide part.
Figure 7:
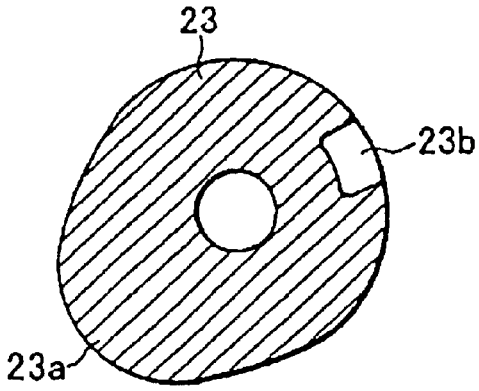
FIG. 7 is a sectional view taken along the VII—VII line of FIG. 4.

The cam mechanism 10 thus configured will be described in further detail with reference to the drawings. FIGS. 1 and 3 show the cam mechanism 10 with the decompression device according to the present invention, where sprocket members 42 shown in FIG. 2 are omitted. First, referring to FIGS. 4 to 7, the camshaft 20 will be described. On the camshaft 20, the intake cam 22, the exhaust cam 23 and a guide part 24 are formed side by side in this order so as to protrude on the circumferential surface of a cylindrical shaft part 21. Note that cam lobes 22*a* and 23*a* for respectively pushing down the intake valves and the exhaust valves are formed in the intake cam 22 and the exhaust cam 23, respectively.

A groove portion 23*b* is formed at a portion in the exhaust cam 23 opposite the cam lobe 23*a* with the shaft part 21 interposed therebetween. This groove portion 23*b* is formed with a side face penetrated on the guide part 24 side. On the other hand, a shaft receiving hole 24*a*, penetrating through in parallel with the shaft part 21, is formed at a portion of the guide post 24 that faces the groove portion 23*b*.

Figure 8:
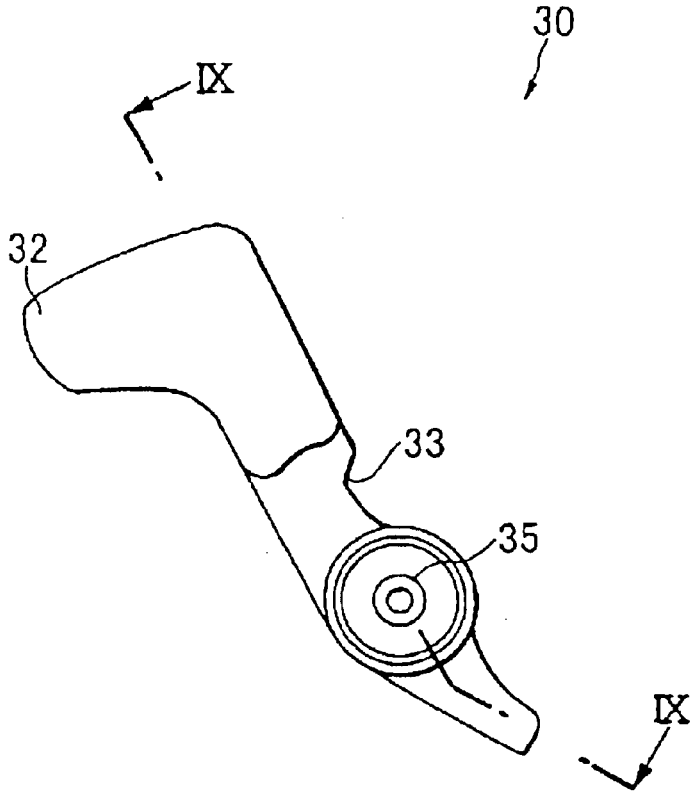
FIG. 8 is a front view of a decompression cam.
Figure 9:
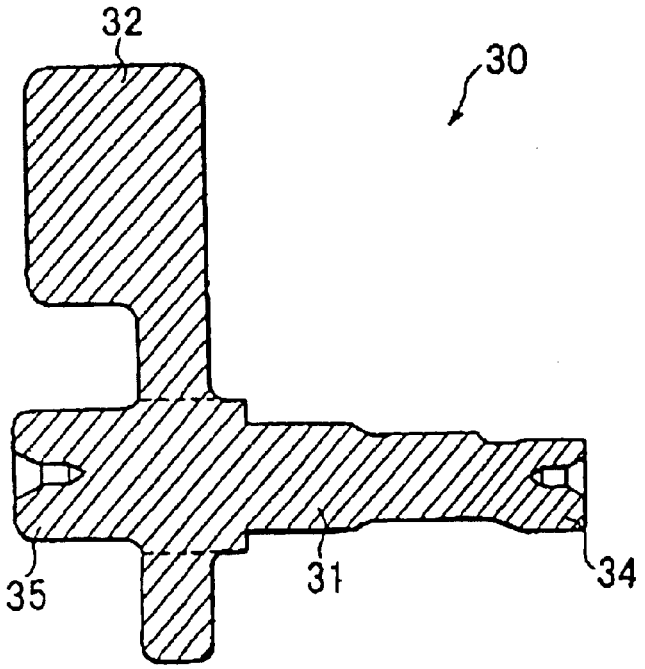
FIG. 9 is a sectional view taken along the IX—IX line of FIG. 8.
Figure 10:
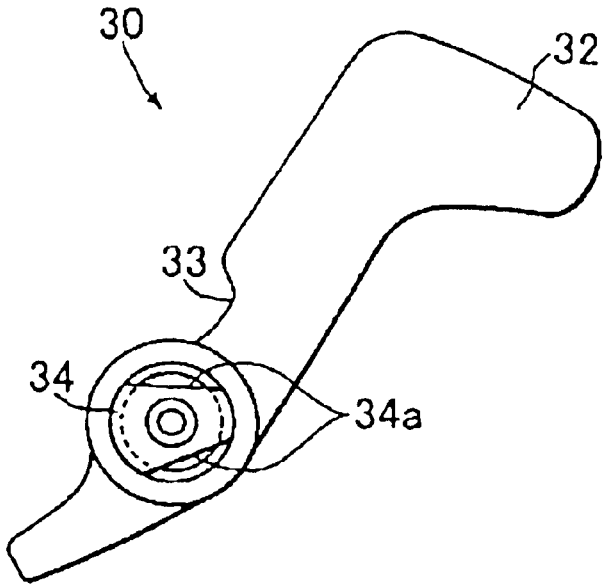
FIG. 10 is a rear view of the decompression cam.

Next, referring to FIGS. 8 to 10, a description will be given of the decompression cam 30 to be fit in the groove portion 23*b* and shaft receiving hole 24*a* of the camshaft 20. On the decompression cam 30, a centrifugal weight part 32, extending in a direction orthogonal to the axis of a shaft part 31, is formed at one end of the cylindrical shaft part 31. A decompression cam lobe 34 is formed at the other end of the shaft part 31, and further, a cylindrical spring attached portion 35, extending from the centrifugal weight part 32 along the axis of the shaft part 31, is formed. The decompression cam lobe 34 has such a shape that part 34*a* (two spots in this embodiment) of the circumferential surface at the other end of the cylindrical shaft part 31 is cut away, and the remaining portion is used as the decompression cam lobe 34 (FIG. 10).

The shaft part 31 is inserted into the shaft receiving hole 24*a* formed in the guide part 24 of the camshaft 20, whereby this decompression cam 30 is rotatably supported, and installed so that the portion where the decompression cam lobe 34 is formed is positioned inside the groove portion 23*b* formed in the exhaust cam 23. In addition, the centrifugal weight part 32 is positioned at the opposite side to the exhaust cam 23 with the guide part 24 interposed therebetween. Therefore, the centrifugal weight part 32 freely rocks relative to the guide part 24, centering around the shaft part 31 supported by the shaft receiving hole 24*a*.

As shown in FIGS. 1 to 3, a return spring 50 is wound around the circumferential surface of the spring attached portion 35 of the decompression cam 30. This return spring 50 is attached so as to energize the centrifugal weight part 32 of the decompression cam 30 toward the camshaft 20. One end of the return spring 50 is latched with a latching portion 33 formed in the vicinity of the shaft part 31, in the centrifugal weight part 32 of the decompression cam 30, and the other end thereof is latched with the shaft part 21 of the camshaft 20. When the return spring 50 is thus configured, combining of the return spring 50 becomes easy since the spring attached portion 35 is positioned so as to protrude from the decompression cam 30 attached to the camshaft 20.

In a state where the decompression cam 30 is attached to the camshaft 20, the decompression cam lobe 34 is formed so as to be positioned protruding outward from the groove portion 23*b* formed in the exhaust cam 23 when the centrifugal weight part 32 is energized by the return spring 50 toward the camshaft 20. When the centrifugal weight part 32 rocks centering around the shaft part 31 to separate from the camshaft 20, the decompression cam lobe 34 is rotated around the shaft part 31, and the decompression cam lobe 34 is positioned inside the groove portion 23*b* of the exhaust cam 23 to be housed therein. Accordingly, the portion protruding outward from the exhaust cam 23 disappears.

Figure 11:
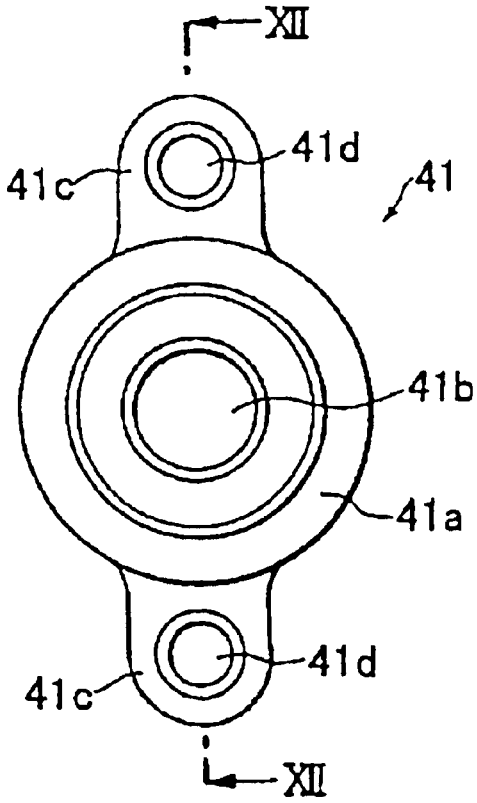
FIG. 11 is a front view of a flange member.
Figure 12:
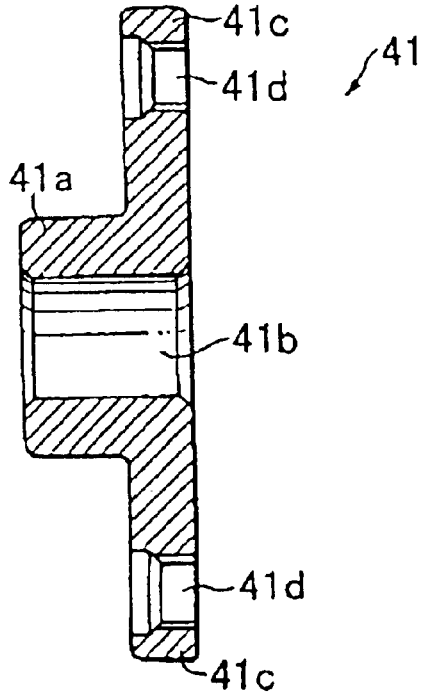
FIG. 12 is a sectional view taken along the XII—XII line of FIG. 11.
Figure 13:
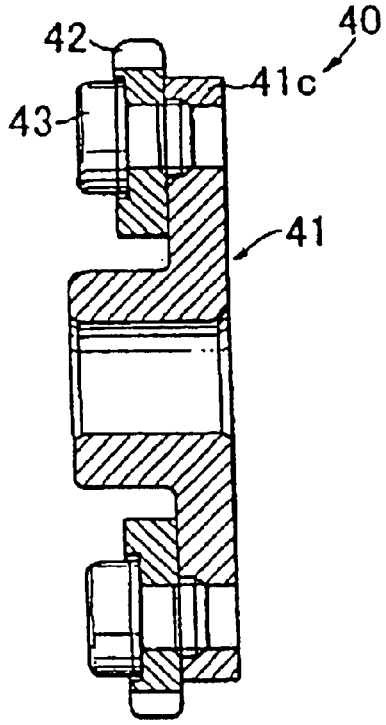
FIG. 13 is a sectional view including an axis of a sprocket.

Moreover, on the camshaft 20 outside the decompression cam 30, the sprocket 40 includes a flange member 41 and the sprocket members 42. As shown in FIGS. 11 and 12, in the flange member 41, formed are two flange portions 41*c* extending, in a flange shape, outward from the circumferential surface of a cylindrical attachment portion 41*a* at one end thereof in a direction of its cylinder axis, opposite to each other with the axis interposed therebetween. A camshaft fit hole 41*b* penetrating along the axis is formed in the attachment portion 41*a*, and sprocket attaching holes 41*d* for attaching the sprocket members 42 as shown in FIG. 13 are formed in the respective two flange portions 41*c*. Note that the sprocket members 42 are attached in such a manner that fastening members 43, such as bolts, are fastened into the sprocket attaching holes 41*d*.

The flange member 41 is fixed in such a manner that the shaft part 21 of the camshaft 20 is forcibly inserted into the camshaft fit hole 41*b* from a face on the side where the flange portions 41*c* extend. In a state where the flange member 41 is attached to the camshaft 20, as shown FIG. 1, the movement of the decompression cam 30 along the shaft receiving hole 24*a* of the guide part 24 is controlled with the flange member 41. Note that adequate clearance is provided between the centrifugal weight part 32 and the guide part 24, and between the centrifugal weight part 32 and the flange member 41 in order not to prevent the freely rocking movement of the centrifugal weight part 32.

The decompression cam 30 is combined to the camshaft 20 as described above. As for a combining method thereof, first, the decompression cam lobe 34 of the decompression cam 30 is inserted into the shaft receiving hole 24*a* formed in the guide part 24 of the camshaft 20, from the opposite side to the exhaust cam 23, and further inserted up to a position where the decompression cam lobe 34 is positioned in the groove portion 23*b* of the exhaust cam 23 and the shaft part 31 is pivotally supported by the shaft receiving hole 24*a*. Thereafter, the return spring 50 is attached to the spring attached portion 35 as described above to energize the decompression cam 30 toward the camshaft 20, and lastly, the sprocket 40 (flange member 41) is pressed onto the camshaft 20 to be attached.

Since the sprocket 40 including the flange member 41 and the sprocket members 42 can be fabricated separately from the main body of the camshaft 20 as described above, the forming and processing thereof is facilitated. Moreover, the decompression cam 30 in which the decompression cam lobe 34 and the centrifugal weight part 32 are integrally formed, makes it possible to reduce the number of parts of the decompression device, whereby the combining characteristic thereof to the camshaft 20 is improved. Further, since the decompression cam 30 can be attached to the camshaft 20 such that the decompression cam 30 is pivotally supported by the guide part 24, it is possible to achieve the small sized decompression device. Furthermore, after the decompression cam 30 is attached to the camshaft 20, the assembly of the cam mechanism 10 is completed if the flange member 41 with the sprocket members 42 attached thereto is pressed onto the camshaft 20 to be fixed. Accordingly, the fabrication and assembly of the whole cam mechanism 10 with the decompression device, as well as combining thereof to the engine, are facilitated.

Figure 14:
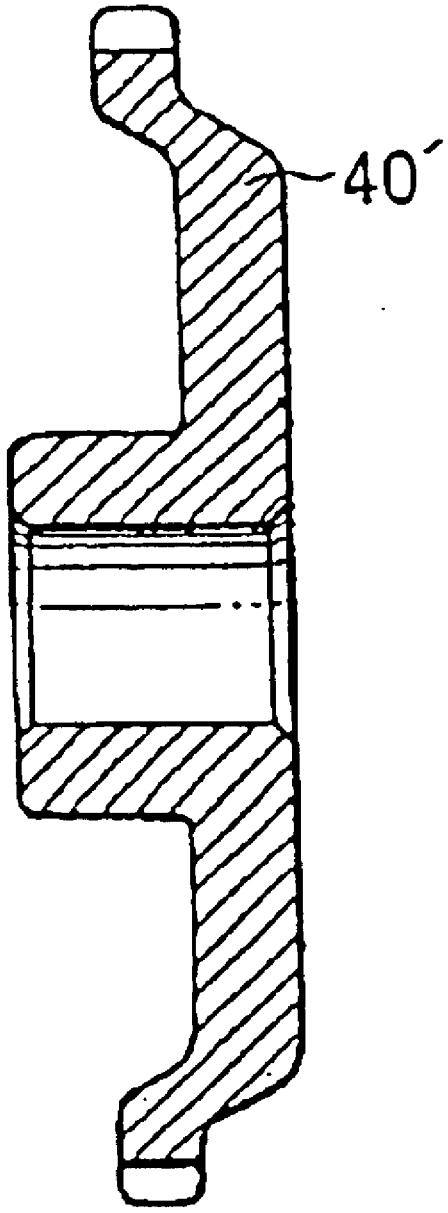
FIG. 14 is a sectional view including an axis of another embodiment of the sprocket.

Incidentally, in the above description, the flange member 41 and the sprocket members 42 are separately configured as the sprocket 40 which transmits the rotation of the crankshaft to the camshaft 20. As shown in FIG. 14, however, a sprocket 41' in which a flange member and sprocket members are integrally configured would make it possible to further reduce the number of parts and also to obtain similar effects.

Lastly, a description will be given of the operation of the cam mechanism 10 with the decompression device thus configured. Before the internal combustion engine E is started, the camshaft 20 is not rotated, and the centrifugal weight part 32 of the decompression cam 30 is energized toward the camshaft 20 by the return spring 50. Therefore, the decompression cam lobe 34 is protruded outward from the groove portion 23*b* of the exhaust cam 23. In this state, when the internal combustion engine E is started, the rotation of the crankshaft is transmitted to the sprocket 40 through the timing belt 7, and the camshaft 20 is rotated. With this rotation of the camshaft 20, the intake cam 22 and the exhaust cam 23 are rotated to open the intake inlets and the exhaust outlets, respectively, and in synchronization with the respective timings, the air/fuel mixture and the exhaust gas are taken in and displaced from the combustion chamber, respectively. At this time, since the decompression cam lobe 34 is protruded, as described above, at the opposite portion in the exhaust cam 23 to the cam lobe 23*a*, the exhaust outlets are slightly opened with the decompression cam lobe 34 at the last moment of a compression stroke apart from a normal exhaust stroke, thus reducing the pressure in the combustion chamber 2.

On the other hand, when the internal combustion engine E is started and the rotation of the camshaft 20 exceeds a given rotational frequency, the centrifugal weight part 32 is swung outward by the centrifugal force against the energizing force of the return spring 50. When the centrifugal weight part 32 is swung outward and rocks, the decompression cam lobe 34 is rotated around the shaft part 31 relative to the guide part 24 to be housed in the groove portion 23*b*, and the exhaust cam 23 comes to have the cam lobe 23*a* only. Accordingly, with the cam lobe 23*a* of the exhaust cam 23, the exhaust outlets are opened only during a normal exhaust stroke.

As described above, in the case of using the cam mechanism 10 with the decompression device according to the present invention for the internal combustion engine E, when the rotation of the camshaft 20 (crankshaft) is at a given speed or less during starting time or the like, the exhaust outlets are slightly opened with the decompression cam lobe 34 at the last moment of a compression stroke to reduce the pressure of the air/fuel mixture in the combustion chamber 2, thereby facilitating combustion. When the internal combustion engine E is started and the rotational speed of the camshaft 20 (crankshaft) becomes faster than a given speed, the decompression cam lobe 34 is housed in the groove portion 23*b*, and the exhaust outlets are not opened with the decompression cam lobe 34. Consequently, the air/fuel mixture is satisfactorily compressed and then burnt, whereby it becomes possible to derive the maximum power of the internal combustion engine E.

Incidentally, since the return spring 50 is attached around the center of the rocking movement of the decompression cam 30 (the spring attached portion 35 located on the axis of the shaft part 31) as described above, it is possible to favorably maintain an operational characteristic to energize the centrifugal weight part 32 toward the camshaft 20 against the centrifugal force imposed on the centrifugal weight part 32, and therefore the starting characteristic of the internal combustion engine E is improved.

As described above, according to the cam mechanism with the decompression device of the present invention, the decompression cam is configured as a decompression cam in which the decompression cam lobe of the decompression device to be attached to the camshaft, and the centrifugal weight for causing the decompression cam lobe to protrude from and be housed in the cam are integrated, whereby the number of parts is reduced, and it is possible to improve the combining characteristic and also to achieve the small sized decompression device.

Moreover, the return spring for energizing the centrifugal weight of the decompression cam toward the camshaft is attached by being wound around the center of the rocking movement of the decompression cam when the decompression cam is attached to the camshaft, whereby it is possible to improve the attaching characteristic of the return spring and also to favorably maintain the operational characteristic to energize, with this return spring, the centrifugal weight toward the camshaft side against the centrifugal force imposed on the centrifugal weight, and therefore, the starting characteristic of the internal combustion engine is improved.

We claim:

1. A cam mechanism with a decompression device comprising:

a camshaft driven to rotate in conjunction with a crankshaft and including at least one cam having a grooved portion opposite a cam lobe with the camshaft interposed therebetween, the camshaft also including a guide part formed near said one cam having a shaft receiving hole penetrating through the guide part orientated parallel to the camshaft at position facing the grooved portion;

a flange member disposed on the camshaft, facing said one cam with the guide part interposed therebetween;

a decompression cam including a cylindrical shaft part, a decompression cam lobe formed on a circumferential surface side at one end of the shaft part, and a centrifugal weight part extending in a direction orthogonal to an axis of the shaft part at the other end of the shaft part;

wherein the decompression cam is disposed in such a manner that the shaft part of the decompression cam can be inserted into the shaft receiving hole and pivotally supported, the cam lobe of the decompression cam can be inserted into the groove portion, and the centrifugal weight part can be positioned between the guide part and the flange member;

wherein the decompression cam is arranged such that when the camshaft rotates at a given rotational speed or less, the centrifugal weight part is positioned near the camshaft, whereby the decompression cam lobe is protruded outward from the groove portion; and when the camshaft rotates faster than the given rotational speed, the centrifugal weight part is separated from the camshaft by centrifugal force, and the shaft part is rotated, whereby the decompression cam lobe is positioned inside the groove portion.

2. The cam mechanism with the decompression device according to claim 1 further comprising:

a spring attached portion formed in such a manner that the decompression cam is extended along the axis of the shaft part; and a return spring wound around the spring attached portion and baying elasticity, wherein a latching portion for latching the return spring is formed in the centrifugal weight part, in the vicinity of the shaft part, and wherein one end of the return spring is latched with the latching portion, the other end is latched onto the camshaft, and the centrifugal weight part is energized toward the camshaft by energizing force of the return spring.

* * * * *